United States Patent [19]

Grundy et al.

[11] Patent Number: 5,031,840

[45] Date of Patent: Jul. 16, 1991

[54] ADJUSTABLE RADIUS SPRINKLER NOZZLE

[75] Inventors: Michael J. Grundy, Pinon Hills, Calif.; Joseph J. Walto, Carver, Minn.

[73] Assignee: The Toro Company, Minneapolis, Minn.

[21] Appl. No.: 406,795

[22] Filed: Sep. 13, 1989

[51] Int. Cl.[5] ..... B05B 1/32

[52] U.S. Cl. ..... 239/456; 239/519; 239/546

[58] Field of Search ..... 239/456, 461, DIG. 12, 239/602, 533.13, 518, 523, 546, 533.14, 519

[56] References Cited

U.S. PATENT DOCUMENTS

| | | | |
|---|---|---|---|
| 2,073,187 | 3/1937 | Webb | 239/546 |
| 2,476,440 | 7/1949 | De La Garde | 239/540 |
| 3,095,175 | 6/1963 | Iketani | 239/546 X |
| 4,119,275 | 10/1978 | Hunter | 239/546 |

FOREIGN PATENT DOCUMENTS 210558 9/1955 Australia .

*Primary Examiner*—Andres Kashnikow
*Assistant Examiner*—Kevin Weldon
*Attorney, Agent, or Firm*—James W. Miller

[57] ABSTRACT

An adjustable arc sprinkler nozzle comprises a lower nozzle piece which is relatively rigid and an upper nozzle piece which is made of a relatively flexible, compressible material. A plurality of radial channels are provided in the upper nozzle piece for forming radial streams out of water flowing into the lower nozzle piece. A deflector ring having pairs of spaced deflecting fingers can selectively compress the upper nozzle piece by pushing down on it adjacent either side of each channel near the radially outer ends thereof. This pinches off the channel area and simultaneously bends the channels down over the lower nozzle piece to decrease the throw radius while keeping the precipitation rate relatively constant.

19 Claims, 3 Drawing Sheets

ADJUSTABLE RADIUS SPRINKLER NOZZLE

TECHNICAL FIELD

This invention relates to a sprinkler nozzle for a water sprinkler which forms radially extending streams of water. More particularly, the present invention relates to a sprinkler nozzle in which the radius of throw of the streams of water can be quickly and easily adjusted without having to change nozzles. Preferably, the throw radius is adjusted while keeping the precipitation rate on the area being sprinkled relatively constant.

BACKGROUND OF THE INVENTION

In the irrigation industry today, many different types of water sprinklers are provided. In many cases, the nozzle is carried on a sprinkler having some mechanism for rotating the nozzle around in a circle. Some such rotary sprinklers also comprise "pop-up" sprinklers. In a "pop-up" sprinkler, the nozzle is carried on the upper end of a "riser" which is normally retracted into an outer sprinkler body buried in the ground.

One well known type of rotary, pop-up sprinkler is the Series 300, Stream Rotor sprinkler manufactured and sold by The Toro Company. The nozzle used in a Stream Rotor sprinkler is made of a lower nozzle piece fixed, as by sonic welding, to an upper nozzle piece. The nozzle includes a series of radially extending nozzle channels which end in a series of outlet ports spaced around the nozzle. Thus, the nozzle throws out a series of radial water streams which rotate around in a circle as the nozzle is rotated by the drive train, giving rise to the name "Stream Rotor".

The pattern of rotating water streams provided by a Stream Rotor nozzle is aesthetically pleasing to many people. In addition, the radius of throw for a given water pressure is increased by forming the water into distinct streams. However, prior to the present invention, it was not possible to easily and quickly adjust the throw radius of a Stream Rotor nozzle. This fact complicated the design and installation of irrigation systems.

For example, if an area is irrigated by multiple Stream Rotor sprinklers, each sprinkler will water a circular area determined by the maximum throw radius of the nozzle. The area of coverage of adjacent sprinklers should desirably overlap a small amount to properly water the area. However, overwatering will result if the sprinkler coverage overlaps too much. Thus, it is often necessary to decrease the throw radius of certain sprinklers to achieve the proper coverage and best results.

Prior to the present invention, for a given water pressure it was the practice to adjust the throw radius by changing nozzles on the sprinkler. Different nozzles were provided by the manufacturer with each nozzle being individually designed to throw water to a certain maximum radius while flowing a certain number of gallons per minute. An installer who needed to decrease the radius of throw of a certain sprinkler would simply choose a nozzle designed to throw to the necessary radius and install that nozzle on the sprinkler. This adjustment process might be required for quite a few sprinklers in an entire irrigation job.

Unfortunately, the need to have on hand an entire array of different nozzles to adjust throw radius complicates the installer's business. If an installer is out of stock on a particular nozzle, and that nozzle is required in a job, then the installer has to go and get one to complete the job, costing him or the customer time and money.

Alternatively, the installer might be tempted to simply install the wrong nozzle on the sprinkler to save the aggravation of having to get the right nozzle. However, this would leave an irrigation system which is not operating as well as it should.

SUMMARY OF THE INVENTION

One aspect of this invention is to provide a simple and durable sprinkler nozzle whose radius of throw can be quickly and easily adjusted.

A nozzle according to this invention is one suited for connection to a sprinkler body. The nozzle comprises a lower nozzle piece having an upwardly facing water dispersing surface. The lower nozzle piece also includes inlet means for conducting water from the sprinkler body to the water dispersing surface for movement radially outwardly of the surface in a sprinkling operation. The nozzle also includes an upper nozzle piece carried on top of and in engagement with the water dispersing surface. The upper nozzle piece includes a plurality of downwardly facing, radially extending channels through which the water flowing on the water dispersing surface must pass to thereby be formed into a plurality of separate radial streams. The channels are compressible and have outlet ends through which the streams exit from the nozzle. Finally, the nozzle includes selectively operable deflector means for compressing the channels in the upper nozzle piece against the lower nozzle piece.

BRIEF DESCRIPTION OF THE DRAWINGS

The present invention will be described hereafter in the Detailed Description, taken in conjunction with the following drawings, in which like reference numerals refer to like elements or parts throughout.

DETAILED DESCRIPTION

Figure 1:
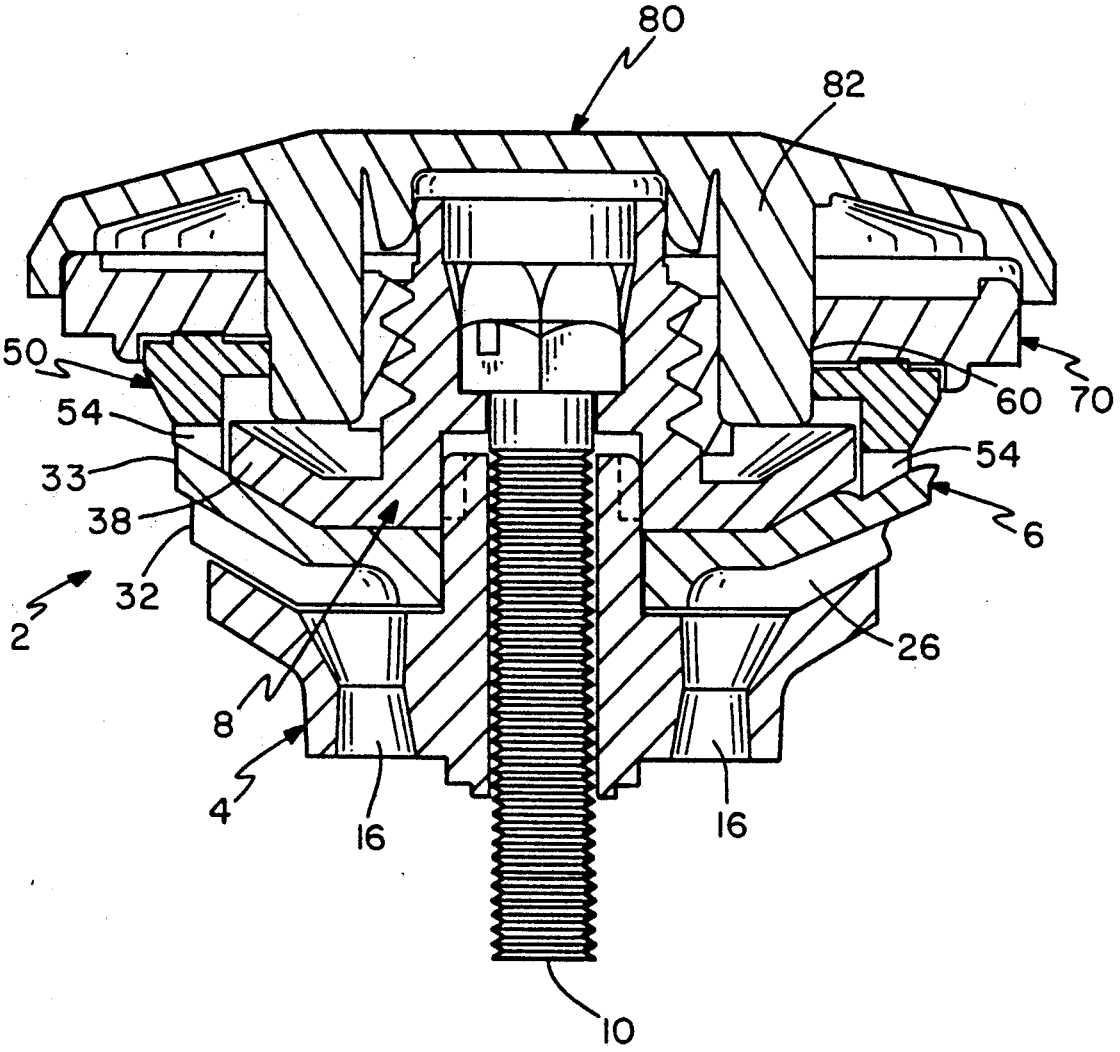
FIG. 1 is a cross-sectional side elevational view of a sprinkler nozzle according to the present invention with the parts thereof shown in an assembled relationship, and illustrating on the left side of FIG. 1 the upper nozzle piece in its normal orientation for throwing water to a maximum radius and on the right side of FIG. 1 the upper nozzle piece in its compressed orientation for throwing water to a shorter radius.

Referring first to FIG. 1, a sprinkler nozzle according to the present invention is shown generally as 2. Nozzle 2 is designed as a Stream Rotor type nozzle, suited for use with the Series 300, Stream Rotor sprinklers manufactured and sold by The Toro Company, the assignee of the present invention. Such sprinklers are illustrated in U.S. Pat. No. 3,854,664, also assigned to The Toro Company, which is hereby incorporated by reference for teaching the details of such sprinklers. However, nozzle 2 is not limited for use with such sprinklers, but can instead be used on any sprinkler body when it is desired to spray relatively discreet radial streams from the nozzle.

Figure 2:
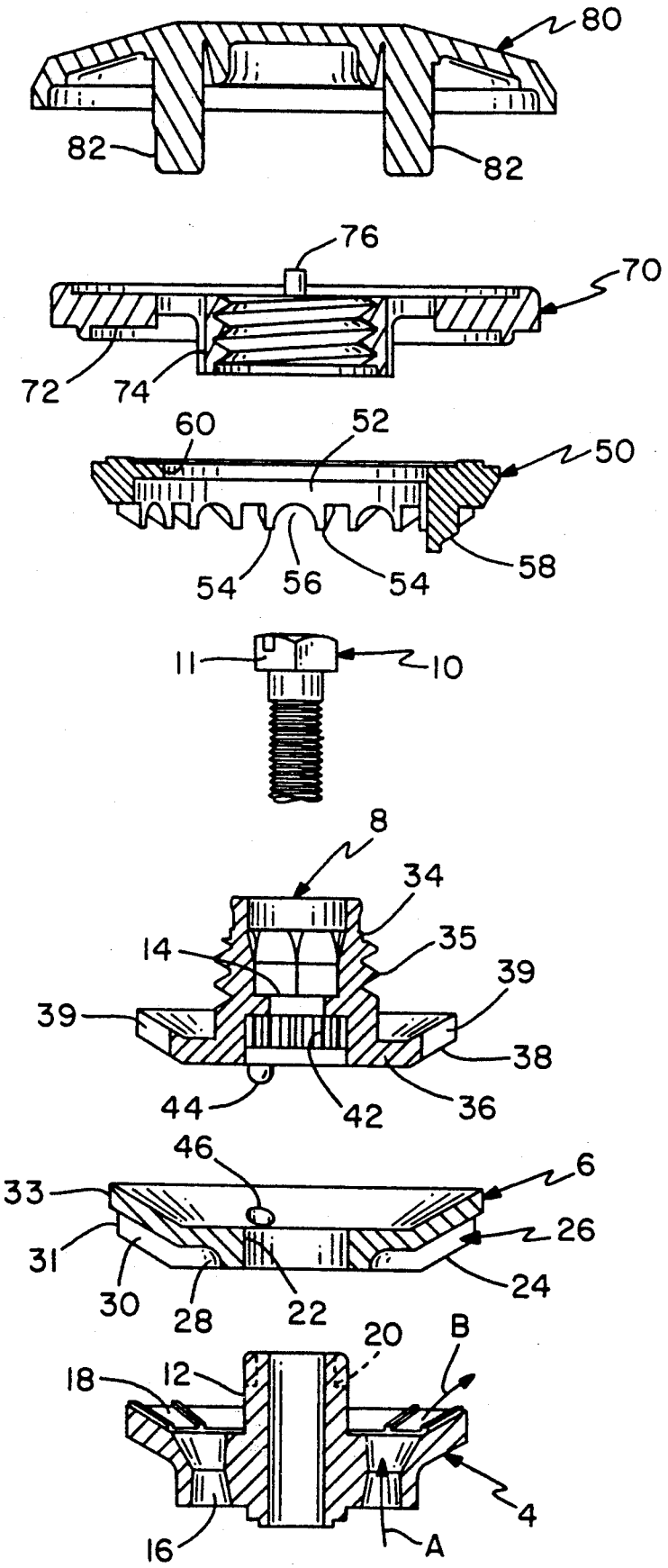
FIG. 2 is an exploded cross-sectional view of the nozzle shown in FIG. 1 with the parts thereof being separated for the purpose of clarity.
Figure 3:
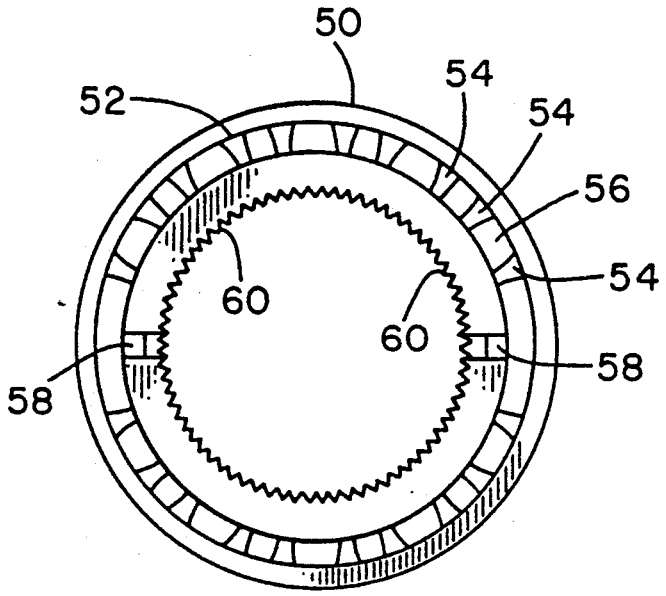
FIG. 3 is a bottom plan view of the deflector ring portion of the sprinkler nozzle shown in FIG. 1.

Nozzle 2 comprises a number of separate parts which may be assembled into a completed unit. FIG. 1 shows the parts in an assembled form, while FIG. 2 illustrates the parts in an exploded form. Reference should be had as needed to such Figures in conjunction with the following description.

Nozzle 2 comprises a lower nozzle piece 4, an upper nozzle piece 6, and means for clamping pieces 4 and 6 together to form a completed nozzle 2. The clamping means comprises a clamping member 8 and a fastening screw 10. Screw 10 may be threaded down into a central stem 12 of lower nozzle piece 4 until the head 11 of screw 10 is tightened against a bearing surface 14 in clamping member 8. When screw 10 is so tightened, upper nozzle piece 6 will be sandwiched between lower nozzle piece 4 and clamping member 8. Thus, screw 10 holds lower nozzle piece 4, upper nozzle piece 6 and clamping member 8 together.

In addition, screw 10 extends substantially below lower nozzle piece 4. This extended portion of screw 10 is threadedly received in the output shaft (not shown) of a gearbox (not shown) in the body of a typical Stream Rotor sprinkler (not shown). Thus, screw 10 also serves to secure nozzle 2 to the sprinkler body in addition to holding the various pieces 4, 6 and 8 of nozzle 2 together. However, other methods of securing nozzle 2 to a sprinkler body could be used. In this event, screw 10 would not have to extend down past lower nozzle piece 4.

As is typical in a Stream Rotor type nozzle, lower nozzle piece 4 includes a plurality of inlet ports 16 spaced circumferentially in a ring around stem 12, two of the ports 16 being shown in FIGS. 1 and 2. Pressurized water passes upwardly through ports 16, as indicated by the arrows A, from the interior of the sprinkler body to which nozzle 2 is attached. In addition, lower nozzle piece 4 includes an upwardly inclined, annular water dispersing surface 18 surrounding ports 16 and leading radially outwardly therefrom. The water will flow radially outwardly along surface 18, as indicated by the arrows B, when confined by the presence of upper nozzle piece 6, as described hereafter.

Upper nozzle piece 6 is generally circular and has a shape so that it can be mated against lower nozzle portion 4. Upper nozzle piece 6 includes a central opening 22 through which stem 12 of lower nozzle piece 4 is inserted. In addition, the lower surface 24 of nozzle piece 6 is formed with a plurality of radially extending channels 26, corresponding in number to the number of ports 16. Each channel 26 has a radially inner end 28 located above one of the ports 16, an upwardly inclined portion 30 along the upwardly inclined radially outer portion of nozzle piece 6, and a radially outer end which defines one outlet port 31 of nozzle 2. When upper nozzle piece 6 is in engagement with lower nozzle piece 4, channels 26 confine and form the water on surface 18 into a plurality of discreet, radial streams.

One important aspect of this invention is that upper nozzle piece 6 is formed of a relatively flexible and compressible material, such as a soft rubber material, while all the other components of nozzle 2, including lower nozzle piece 4, are molded from relatively hard plastic materials of the type often used in sprinklers. The use of such a soft, compressible material in upper nozzle piece 6 allows the channels 26 to be bent and compressed as described later to adjust the radius of throw of the nozzle streams. In addition, as shown in FIG. 1, upper nozzle piece 6 has a slightly larger diameter than lower nozzle piece 4 to form a small portion 32 that overhangs or extends beyond lower nozzle piece 4. The use of this overhang portion 32 is also preferred as described hereafter.

Clamping member 8 includes a generally cylindrical body 34 with an annular flange 36 at its bottom end. Flange 36 includes an upwardly inclined portion 38 which again mimics the shape of the nozzle pieces 6 and 8 so as to mate firmly thereagainst. See FIG. 1. Clamping member 8 has a longitudinal passageway 40 through which screw 10 extends down into lower nozzle piece 4. Bearing surface 14 is located in the middle of passageway 14 and an annular array of grooves or flutes 42 is placed adjacent the lower end of passageway 40. Flutes 42 form a splined connection with a similar array of grooves of flutes 20 on the top of stem 12 of lower nozzle piece 4.

In assembling the components of nozzle 2 described so far, upper nozzle piece 6 can be pushed down over lower nozzle piece 4 until stem 12 passes upwardly through opening 22 and the mating surfaces of the two pieces are engaged against one another. Then, stem 12 is inserted into passageway 40 of clamping member 8 and clamping member 8 is pushed down over the stem until it firmly engages against the top of upper nozzle piece 6. Clamping member 8 includes two downwardly projecting pins 44 which are received in shallow holes 46 in the top of upper nozzle piece 6. This pin and hole connection between upper nozzle piece 6 and clamping member 8, in conjunction with the splined connection between clamping member 8 and lower nozzle piece 4, aligns the radial channels 26 in upper nozzle piece 6 with the ports 16 in lower nozzle piece 4. Then, screw 10 is inserted into passageway 40 and tightened in lower nozzle piece 4 until it firmly engages bearing surface 14.

As described thus far, nozzle 2 would be operative to dispense water in radially extending streams through channels 26 in upper nozzle piece 6. The parts are configured so that clamping member 8 will firmly hold the upper nozzle piece 6 against the lower nozzle piece 4 when screw 10 is fully tightened, but will not significantly deform channels 26. Thus, channels 26 normally have an undeformed orientation, shown in FIG. 4, in which the flow area of the channel is unobstructed. Further, in this orientation, channel 26 has a trajectory angle which is the same as that formed by the inclined portion 30 of the upper nozzle piece 6. Thus, as shown on the left side of FIG. 1, nozzle 2 will be throwing to its maximum radius in this channel configuration.

However, the present invention is specifically directed to a nozzle 2 which can be selectively manipulated to throw to shorter radii. Accordingly, nozzle 2 also includes deflecting means for compressing upper nozzle piece 6 against lower nozzle piece 4 to deform or compress channels 26. The deflecting means comprises an annular deflecting ring 50 and a selectively rotatable adjusting member 70.

Figure 4:
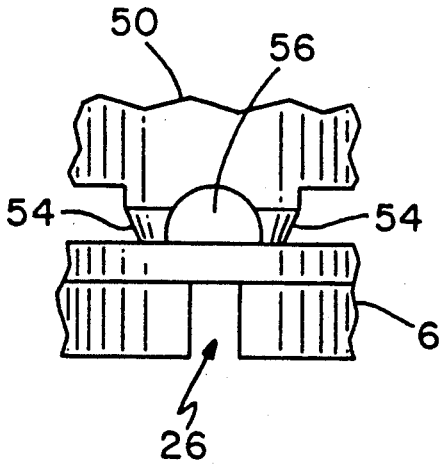
FIG. 4 is an enlarged side elevational view of one of the channels in the upper nozzle piece with the deflector ring not having compressed the channel from its normal orientation, corresponding to the maximum throw radius situation shown on the left side of FIG. 1.
Figure 5:
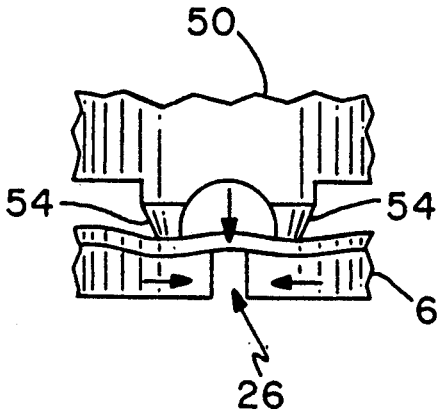
FIG. 5 is an enlarged side elevational view similar to that shown in FIG. 4, but illustrating the deflector ring as having compressed the channel from its normal orientation into a compressed orientation, corresponding to the shorter throw radius situation shown on the right side of FIG. 1.

Deflecting ring 50 has a downwardly extending rim 52. Rim 52 includes a plurality of pairs of spaced, downwardly extending fingers 54 separated by a semi-circular arch or recess 56. One such pair of fingers 54 is shown in FIGS. 4 and 5. In addition, rim 52 has a diameter large enough to allow deflecting ring 50 to be dropped down around clamping member 8. In this position, fingers 54 will extend down past the peripheral edge of flange 36 of clamping member 8 to bear against the top surface of upper nozzle piece 6. See FIG. 1.

In addition, deflecting ring 50 includes two downwardly extending alignment tabs 58 spaced radially inwardly from rim 52. Tabs 58 are received in two slots 39 in the inclined portion 38 of flange 36 of clamping member 8. The tab and slot connection aligns deflecting ring 50 with clamping member 8, and hence with upper nozzle piece 6, so that the fingers 54 in each pair will push down on upper nozzle piece 6 on either side of channel 26, as shown in FIGS. 4 and 5. In addition, the inner diameter of deflecting ring 50 contains serrations 60 for a purpose to be described hereafter.

Adjusting member 70 includes a substantially flat horizontal bearing surface 72 which bears against the top of deflecting ring 50. In addition, adjusting member 70 includes a hollow, central stem 74 which is interiorly threaded to engage external screw threads 35 provided on the exterior of clamping member 8. This threaded connection allows adjusting member 70 to be vertically moved relative to clamping member 8. Downward movement of adjusting member 70 also forces deflecting ring 50 downwardly to compress upper nozzle piece 6 against lower nozzle piece 4.

Preferably, the initial position of adjusting member 70 is one in which deflecting ring 50 engages, but does not compress, upper nozzle piece 6. This position, as shown in FIG. 4, allows nozzle 2 to throw water to its maximum radius. Then, if it is desired to shorten the throw radius, the operator or installer need only rotate adjusting member 70 downwardly on clamping member 8. This moves deflecting ring 50 downwardly to compress upper nozzle piece 6. Preferably, the top of adjusting member 70 is provided with two opposed ridges or tabs 76 to allow the installer to more easily grip adjusting member 70 to rotate it.

Two things happen when deflecting ring 50 compresses upper nozzle piece 6. First, the flow area of channel 26 is decreased or "pinched off" as shown in FIG. 5 in a uniform fashion, thereby allowing less water to flow through the channel. This decrease in the water flow will cause the radius of throw to shorten. In addition, since deflecting fingers 54 of ring 50 act on overhang portion 32 of upper nozzle piece 6, their downward movement also bends the overhang portion down over the lower nozzle piece 4, as shown on the right side of FIG. 1. This simultaneously lowers the trajectory angle of the water streams being thrown from channels 26.

Thus, nozzle 2 effectively decreases the throw radius for two reasons. First, because the amount of water flowing through the channels is decreased and, secondly, because the trajectory angle is simultaneously lowered. While throw radius could be decreased using either of these actions separately, the combination of the two actions is preferred. Applicants have discovered that in using both actions the radius can be decreased while keeping the precipitation rate relatively constant. In other words, as the trajectory angle lowers to decrease throw radius, the volume of water passing through the sprinkler lowers in concert with it, so that approximately the same amount of water is applied per unit area per unit time regardless of the radius chosen.

Accordingly, nozzle 2 according to this invention can be used to quickly and easily adjust the throw radius of a particular sprinkler without having to change nozzles. Now, all the installer need do to shorten the throw radius is to reach down and rotate adjusting member 70 downwardly until the radius has been sufficiently shortened. He no longer has to remove one nozzle to insert another. Thus, the installer only has to stock the single adjustable nozzle 2, and need not carry various differently sized nozzles as before. In addition, nozzle 2 can shorten its radius without an increase in the precipitation rate due to the simultaneous volumetric flow restrictions imposed by the pinching off of channels 26.

As illustrated in FIGS. 1 and 2, upper nozzle piece 6 is provided with an upper peripheral rim or shoulder 33 that extends out beyond channels 26. This rim serves as a support surface for various small fingers or obstructions (not shown) which extend down and partially obscure the outlet ends 31 of some, but not all, of the channels 26. These obstructions can have different shapes and lengths. Preferably, they could comprise small, semi-circular bumps molded onto the bottom of rim 33 to lie in front of channels 26.

Such obstructions as described above break up the streams of water exiting from certain channels 26 so that such streams cover the radially innermost portions of the circle being irrigated. Since most of the channels are unobstructed, the water streams exiting those channels will be projected to the radially outermost portions of the circle. Thus, obstructing at least some of the channels 26 will cause the entire pattern to be uniformly watered. However, the presence of rim or shoulder 33 is not important to the throw shortening feature of nozzle 2 and could be dispensed with if so desired.

In addition, the alignment tabs 58 on deflecting ring 50, after passing through slots 39 in clamping member 8, are aligned to be on top of two of the radial channels 26 in upper nozzle piece 6. Applicants have discovered from trial and error that it is sometimes necessary to restrict flow through at least a few of the channels 26 by more than the amount of compression provided by fingers 54 to help hold the precipitation rate constant as the throw radius comes down. This additional flow restriction is provided by making tabs 58 sufficiently long to normally compress two of the channels 26 even when the deflecting ring 50 is not otherwise compressing upper nozzle piece 6. The exact length required for tabs 58 to accomplish this "fine tuning" of the flow will vary depending on the desired precipitation rate for which nozzle 2 is designed.

While tabs 58 could overlie any two channels, it is preferred if they overlie those two channels which have the largest obstructions on rim 33, i.e. those two channels which are throwing to the inner portions of the pattern. Applicants have found that when the radius of nozzle 2 is shortened, and the trajectory angle of all the streams is lowered, the obstructed streams used to water the inner portions of the pattern can impact the ground with considerable force around the sprinkler, even to the extent of digging up the ground a bit. Thus, if additional volumetric flow restriction is required by adjusting the length of tabs 58, one might as well compress the channels throwing the most obstructed streams. This has the additional benefit of lessening the force with which the streams exit from such channels, thereby tending not to dig up the ground immediately adjacent the sprinkler even when nozzle 2 has been adjusted to throw short radii.

Another auxiliary feature of nozzle 2 is provided by the last component to be described, i.e. the locking cap or cover 80. Normally, if one were to look down on the top of nozzle 2, one would see adjusting member 70 along with printed directions on ring 70 for rotating it to adjust the throw radius of nozzle 2. This would serve as a temptation to vandals to reach down and rotate ring 70, thereby destroying the setting provided by the installer and requiring someone to reset it. In addition, it would also be desirable to have some means of locking adjusting member 70 in place to prevent accidental movement of ring 70.

Cover 80 provides both functions. It comprises a circular cap sufficiently large in diameter to cover adjusting member 70. This hides adjusting member 70 from casual view. Thus, cover 80 provides some vandal protection as it is not immediately apparent that nozzle 2 has such a thing as a rotatable adjusting member 70.

In addition, cover 80 is provided with two downwardly extending locking lugs 82. These lugs 82 pass downwardly through two holes provide in adjusting member 70 until they engage the serrations 60 on the inner diameter of deflecting ring 50. This locks or retains adjusting member 70 in place. However, cover 80 has a press fit on adjusting member 70 so that it can be easily popped off when it is desired to intentionally rotate member 70 to adjust the throw radius. Cover 80 can then be pressed back into place.

Various modifications of this invention will be apparent to those skilled in the art. For example, channels 26 have been illustrated herein as having a square cross-sectional configuration, but different configurations could obviously be used. Accordingly, the present invention is to be limited only by the appended claims.

We claim:

1. An adjustable radius sprinkler nozzle suited for connection to a sprinkler body, which comprises:

(a) a lower nozzle piece having an upwardly facing water dispersing surface, wherein the lower nozzle piece includes inlet means for conducting water from the sprinkler body to the water dispersing surface for movement radially outwardly of the surface in a sprinkling operation;

(b) an upper nozzle piece carried on top of and in engagement with the water dispersing surface, wherein the upper nozzle piece includes a plurality of downwardly facing, radially extending channels through which the water flowing on the water dispersing surface must pass to thereby be formed into a plurality of separate radial streams, wherein the channels are compressible and have outlet ends through which the streams exit from the nozzle; and (c) selectively operable deflector means for compressing the channels in the upper nozzle piece against the lower nozzle piece, wherein the deflector means acts on the channels adjacent the outlet ends of the channels to simultaneously restrict the water flowing through the channels and to lower the trajectory angle of the channels, thereby shortening the radius of the water being delivered by the nozzle while maintaining the precipitation rate relatively constant.

2. An adjustable radius sprinkler nozzle as recited in claim 1, wherein the upper nozzle is formed from a compressible material, and the channels are integrally formed in the upper nozzle piece.

3. An improved sprinkler nozzle, which comprises:

(a) a lower nozzle piece having an upwardly facing, water dispersing surface bounded by a peripheral edge thereof, wherein the lower nozzle piece includes inlet means for conducting water to the water dispersing surface;

(b) an upper nozzle piece in engagement with the water dispersing surface, wherein the upper nozzle piece is made from a flexible material and is larger than the lower nozzle piece to overhang the peripheral edge of the lower nozzle piece;

(c) one or more radially extending channels contained on the upper nozzle piece for directing the water reaching the water dispersing surface into one or more outwardly flowing radial streams; and (d) selectively operable deflector means for bending the upper nozzle piece down over the peripheral edge of the lower nozzle piece to change the trajectory of the radial streams exiting from the channels.

4. An improved sprinkler nozzle as recited in claim 3, wherein the radially extending channels on the upper nozzle piece face downwardly towards the upper dispersing surface.

5. An adjustable radius sprinkler nozzle suited for connection to a sprinkler body, which comprises:

(a) a relatively rigid lower nozzle piece having an annular, upwardly facing water dispersing surface, wherein the lower nozzle piece includes inlet means for conducting the water from the sprinkler body to the water dispersing surface for movement radially outwardly of the surface in a sprinkling operation;

(b) an annular, relatively flexible upper nozzle piece made from a compressible material, wherein the upper nozzle piece is placed on top of and in engagement with the water dispersing surface, wherein the upper nozzle piece has a slightly larger diameter than that of the lower nozzle piece so that an outermost peripheral edge thereof overhangs the lower nozzle piece, and wherein the upper nozzle piece includes a plurality of downwardly facing, radially extending channels through which the water flowing on the water dispersing surface must pass to thereby be formed into a plurality of separate streams;

(c) means for clamping the upper nozzle piece to the lower nozzle piece to form an assembled nozzle with the channels being maintained by the clamping means in a normal orientation for delivering water to a predetermined maximum radius; and (d) selectively operable deflector means for compressing the upper nozzle piece against the lower nozzle piece to deflect the channels into a compressed orientation in which less water is able to flow through the channels than in the normal orientation thereof, thereby shortening the radius of the water being delivered by the nozzle from the maximum radius to a smaller radius, and wherein the deflector means acts on the overhang portion of the upper nozzle piece to bend the upper nozzle piece down over the lower nozzle piece simultaneously with the compression of the upper nozzle piece against the lower nozzle piece, thereby lowering the angle of trajectory of the water streams as the water flow through the channels is decreased by the compression of the upper nozzle piece.

6. An adjustable radius sprinkler nozzle suited for connection to a sprinkler body, which comprises:

(a) a relatively rigid lower nozzle piece having an annular, upwardly facing water dispersing surface, wherein the lower nozzle piece includes inlet means for conducting the water from the sprinkler body to the water dispersing surface for movement radially outwardly of the surface in a sprinkling operation, wherein the water dispersing surface of the lower nozzle piece is inclined upwardly relative to the horizontal at an angle selected to allow the water streams to reach a pre-determined maximum radius;

(b) an annular, relatively flexible upper nozzle piece made from a compressible material, wherein the upper nozzle piece is displaced on top of and in engagement with the water dispersing surface, wherein the upper nozzle piece includes a plurality of downwardly facing, radially extending channels through which the water flowing on the water dispersing surface must pass to thereby be formed into a plurality of separate streams, and wherein the channels in the upper nozzle piece are provided on a lower side thereof which is also normally inclined at the same angle as that of the water dispersing surface to mate thereagainst;

(c) means for clamping the upper nozzle piece to the lower nozzle piece to form an assembled nozzle with the channels being maintained by the clamping means in a normal orientation for delivering water to the predetermined maximum radius; and (d) selectively operable deflector means for compressing the upper nozzle piece against the lower nozzle piece to deflect the channels into a compressed orientation in which less water is able to flow through the channels than in the normal orientation thereof, thereby shortening the radius of the water being delivered by the nozzle from the maximum radius to a smaller radius.

7. An adjustable radius sprinkler nozzle as recited in claim 6, wherein the upper nozzle piece has a slightly larger diameter than that of the lower nozzle piece so that an outermost peripheral edge thereof overhangs the lower nozzle piece, and wherein the deflector means acts on the overhang portion of the upper nozzle piece to bend the upper nozzle piece down over the lower nozzle piece simultaneously with the compression of the upper nozzle piece against the lower nozzle piece, thereby lowering the angle of trajectory of the water streams as the water flow through the channels is simultaneously decreased by the compression of the upper nozzle piece.

8. An adjustable radius sprinkler nozzle suited for connection to a sprinkler body, which comprises:

(a) a relatively rigid lower nozzle piece having an annular, upwardly facing water dispersing surface, wherein the lower nozzle piece includes inlet means for conducting the water from the sprinkler body to the water dispersing surface for movement radially outwardly of the surface in a sprinkling operation;

(b) an annular, relatively flexible upper nozzle piece made from a compressible material, wherein the upper nozzle piece is placed on top of and in engagement with the water dispersing surface, and wherein the upper nozzle piece includes a plurality of downwardly facing, radially extending channels through which the water flowing on the water dispersing surface must pass to thereby be formed into a plurality of separate streams;

(c) means for clamping the upper nozzle piece to the lower nozzle piece to form an assembled nozzle with the channels being maintained by the clamping means in a normal orientation for delivering water to a predetermined maximum radius; and (d) selectively operable deflector means for compressing the upper nozzle piece against the lower nozzle piece to deflect the channels into a compressed orientation in which less water is able to flow through the channels than in the normal orientation thereof, thereby shortening the radius of the water being delivered by the nozzle from the maximum radius to a smaller radius, wherein the deflector means comprises a plurality of downwardly facing deflector fingers which engage against the upper nozzle piece, wherein a pair of spaced deflector fingers is provided for each channel with the fingers in each pair pressing down on the upper nozzle piece adjacent opposite sides of the channel.

9. An adjustable radius sprinkler nozzle suited for connection to a sprinkler body, which comprises:

(a) a relatively rigid lower nozzle piece having an annular, upwardly facing water dispersing surface, wherein the lower nozzle piece includes inlet means for conducting the water from the sprinkler body to the water dispersing surface for movement radially outwardly of the surface in a sprinkling operation;

(b) an annular, relatively flexible upper nozzle piece made from a compressible material, wherein the upper nozzle is placed on top of an in engagement with the water dispersing surface, and wherein the upper nozzle piece includes a plurality of downwardly facing, radially extending channels through which the water flowing on the water dispersing surface must pass to thereby be formed into a plurality of separate streams;

(c) means for clamping the upper nozzle piece to the lower nozzle piece to form an assembled nozzle with the channels being maintained by the clamping means in a normal orientation for delivering water to a predetermined maximum radius, wherein the clamping means comprises:

(i) a clamping member on top of and in engagement with the upper nozzle piece to sandwich the upper nozzle piece between the clamping member and the lower nozzle piece; and (ii) securing means for mixing the clamping member to the lower nozzle piece; and (d) selectively operable deflector means for compressing the upper nozzle piece against the lower nozzle piece to deflect the channels into a compressed orientation in which less water is able to flow through the channels than in the normal orientation thereof, thereby shortening the radius of the water being delivered by the nozzle from the maximum radius to a smaller radius.

10. An adjustable radius sprinkler nozzle as recited in claim 9, wherein the deflector means is rotatably carried on the clamping member.

11. An adjustable radius sprinkler nozzle as recited in claim 10, wherein the upper nozzle piece has a slightly larger diameter than that of the lower nozzle piece so that an outermost peripheral edge thereof overhangs the lower nozzle piece, and wherein the deflector means acts on the overhang portion of the upper nozzle piece to bend the upper nozzle piece down over the lower nozzle piece simultaneously with the compression of the upper nozzle piece against the lower nozzle piece, thereby lowering the angle of trajectory of the water streams as the water flow through the channels is decreased by the compression of the upper nozzle piece.

12. An adjustable radius sprinkler nozzle as recited in claim 10, wherein the deflector means comprises:

(a) a deflector ring having a plurality of downwardly extending deflector fingers passing adjacent the clamping member to engage against an upper side of the upper nozzle piece; and (b) an adjusting member overlying the deflector ring to engage and bear downwardly on the deflector ring, whereby the adjusting member is rotatably carried on the clamping member and axially moves the deflector ring downwardly to cause the fingers to compress the upper nozzle piece as the adjusting member is rotated on the clamping member.

13. An adjustable radius sprinkler nozzle as recited in claim 12, wherein a pair of spaced deflector fingers is provided for compressing the upper nozzle piece adjacent each of the channels therein, wherein the fingers in each pair are located adjacent to and slightly outside each side of a channel.

14. An adjustable radius sprinkler nozzle as recited in claim 13, wherein the clamping member includes a plurality of slots in an outermost peripheral edge thereof, and wherein the deflector ring includes a plurality of indexing tabs which are received in the slots to properly position the deflector ring relative to the upper nozzle piece.

15. An adjustable radius sprinkler nozzle suited for connection to a sprinkler body, which comprises:

(a) a first nozzle piece having a water dispersing surface, wherein the first nozzle piece includes inlet means for conducting water from the sprinkler body to the water dispersing surface for movement radially outwardly of the surface in a sprinkling operation;

(b) a second nozzle piece in engagement with the water dispersing surface of the first nozzle piece, wherein the second nozzle piece includes a plurality of radially extending channels through which the water flowing on the water dispersing surface must pass to thereby be formed into a plurality of separate radial streams, wherein the channels are compressible and have outlet ends through which the streams exit from the nozzle; and (c) selectively operable deflector means for compressing the channels in the second nozzle piece against the first nozzle piece, wherein the deflector means acts on the channels adjacent the outlet ends of the channels to simultaneously restrict the water flowing through the channels and to lower trajectory angle of the channels, thereby shortening the radius of the water being delivered by the nozzle while maintaining the precipitation rate relatively constant.

16. An adjustable radius sprinkler nozzle suited for connection to a sprinkler body, which comprises:

(a) a first nozzle piece having a water dispersing surface, wherein the first nozzle piece includes inlet means for conducting water from the sprinkler body to the water dispersing surface for movement radially outwardly of the surface in a sprinkling operation;

(b) a second nozzle piece in engagement with the water dispersing surface of the first nozzle piece, wherein the second nozzle piece includes a plurality of radially extending channels through which the water flowing on the water dispersing surface must pass to thereby be formed into a plurality of separate radial streams, wherein the channels are compressible and have outlet ends through which the streams exit from the nozzle; and (c) selectively operable deflector means for compressing the channels in the second nozzle piece against the first nozzle piece, wherein the deflector means comprises a plurality of deflector fingers which engage against the second nozzle piece, and wherein the deflector fingers act on the channels only adjacent the outlet ends thereof.

17. An adjustable radius sprinkler nozzle suited for connection to a sprinkler body, which comprises:

(a) a first nozzle piece having a water dispersing surface, wherein the first nozzle piece includes inlet means for conducting water from the sprinkler body to the water dispersing surface for movement radially outwardly of the surface in a sprinkling operation;

(b) a second nozzle piece in engagement with the water dispersing surface of the first nozzle piece, wherein the second nozzle piece includes a plurality of radially extending channels through which the water flowing on the water dispersing surface must pass to thereby be formed into a plurality of separate radial streams, wherein the channels are compressible; and (c) selectively operable deflector means for compressing the channels in the second nozzle piece against the first nozzle piece, wherein the deflector means comprises a plurality of deflector fingers which engage against the second nozzle piece, wherein a pair of spaced deflector fingers is provided for each channel with the fingers in each pair pressing on the second nozzle piece adjacent opposite sides of the channel.

18. An adjustable radius sprinkler nozzle are recited in claim 17, further including means for clamping the first and second nozzle pieces together to form an assembled nozzle with the channels being maintained by the clamping means in a normal orientation for delivering water to a predetermined maximum radius, and wherein the deflector fingers are separate from and are independently movable relative to the clamping means to act independently on the second nozzle piece.

19. An adjustable radius sprinkler nozzle suited for connection to a sprinkler body, which comprises:

(a) a first nozzle piece having a water dispersing surface, wherein the first nozzle piece includes inlet means for conducting water from the sprinkler body to the water dispersing surface for movement radially outwardly of the surface in a sprinkling operation;

(b) a second nozzle piece in engagement with the water dispersing surface of the first nozzle piece, wherein the second nozzle piece includes a plurality of radially extending channels through which the water flowing on the water dispersing surface must pass to thereby be formed into a plurality of separate radial streams, wherein the channels are compressible;

(c) means for clamping the first and second nozzle pieces together to form an assembled nozzle with the channels being maintained by the clamping means in a normal orientation for delivering water to a predetermined maximum radius; and (d) selectively operable deflector means for compressing the channels in the second nozzle piece against the first nozzle piece, wherein the deflector means is separate from the clamping means to act on the second nozzle piece independently of the clamping means.

* * * * *

UNITED STATES PATENT AND TRADEMARK OFFICE

CERTIFICATE OF CORRECTION

PATENT NO. : 5,031,840

DATED : July 16, 1991

INVENTOR(S) : Michael J. Grundy et al.

It is certified that error appears in the above-identified patent and that said Letters Patent is hereby corrected as shown below:

In claim 6, "displaced" should read --placed-- at Column 9, line 14.

In claim 9, "upper nozzle" should read --upper nozzle piece-- at Column 10, line 32; "an" should read --and-- at Column 10, line 32; and "mixing" should read --fixing-- at Column 10, line 49.

In claim 15, "to lower" should read --to lower the-- at Column 11, line 54.

Signed and Sealed this

First Day of December, 1992

*Attest:*

DOUGLAS B. COMER

*Attesting Officer*

*Acting Commissioner of Patents and Trademarks*